US005638892A

United States Patent [19]

Barbe et al.

[11] Patent Number: 5,638,892

[45] Date of Patent: Jun. 17, 1997

[54] METHOD AND DEVICE FOR CONTINUOUS CASTING OF THIN METALS PRODUCTS BETWEEN ROLLS

[75] Inventors: Jacques Barbe; François Mazodier, both of Saint-Entienne; Luc Vendeville, Bethune; Pierre DeLassus, Bethune, all of France

[73] Assignees: Usinor-Sacilor, Puteaux, France; Thyssen Stahl Aktiengesellschaft, Duisburg, Germany

[21] Appl. No.: 497,166

[22] Filed: Jun. 30, 1995

[30] Foreign Application Priority Data

Jun. 30, 1994 [FR] France ..... 94 08361

[51] Int. Cl.[6] ..... B22D 11/06; B22D 11/16

[52] U.S. Cl. ..... 164/452; 164/151; 164/154.8; 164/428; 164/480

[58] Field of Search ..... 164/452, 480, 164/428, 151, 154.8

[56] References Cited

FOREIGN PATENT DOCUMENTS

| | | | |
|---|---|---|---|
| 0546206 | 6/1993 | European Pat. Off. . | |
| 59-215255 | 12/1984 | Japan | 164/480 |
| 63-36954 | 2/1988 | Japan | 164/428 |
| 4-228243 | 8/1992 | Japan | 164/428 |
| 4-231149 | 8/1992 | Japan | 164/428 |
| 4-322849 | 11/1992 | Japan | 164/480 |
| 5-269553 | 10/1993 | Japan | 164/428 |

OTHER PUBLICATIONS

Patent Abstracts of Japan, vol. 16, No. 576; No. 4–224052 Published Aug. 13, 1992.

Patent Abstracts of Japan, vol. 13, No. 41; No. 63–248547 Published Oct. 14, 1988.

Patent Abstracts of Japan, vol. 12, No. 445; No. 63–177944 Published Jul. 22, 1988.

*Primary Examiner*—J. Reed Batten, Jr.

*Attorney, Agent, or Firm*—Nilles & Nilles, S.C.

[57] ABSTRACT

A strip is continuously cast between rolls that includes a pair of rolls driven in rotation, two side dams urged against the ends of the rolls, and a jack for pressing the side dams against the rolls. The thrust force on the side dams is measured and the friction force exerted on the side dams by the rolls as a result of the rolls rotating is measured. From these measurements of thrust and friction forces, a coefficient representative of friction conditions between each of the surfaces of contact between the side dams and rolls is deduced and casting parameters are adjusted in response to the contact state between the surfaces.

12 Claims, 1 Drawing Sheet

METHOD AND DEVICE FOR CONTINUOUS CASTING OF THIN METALS PRODUCTS BETWEEN ROLLS

Figure 1:
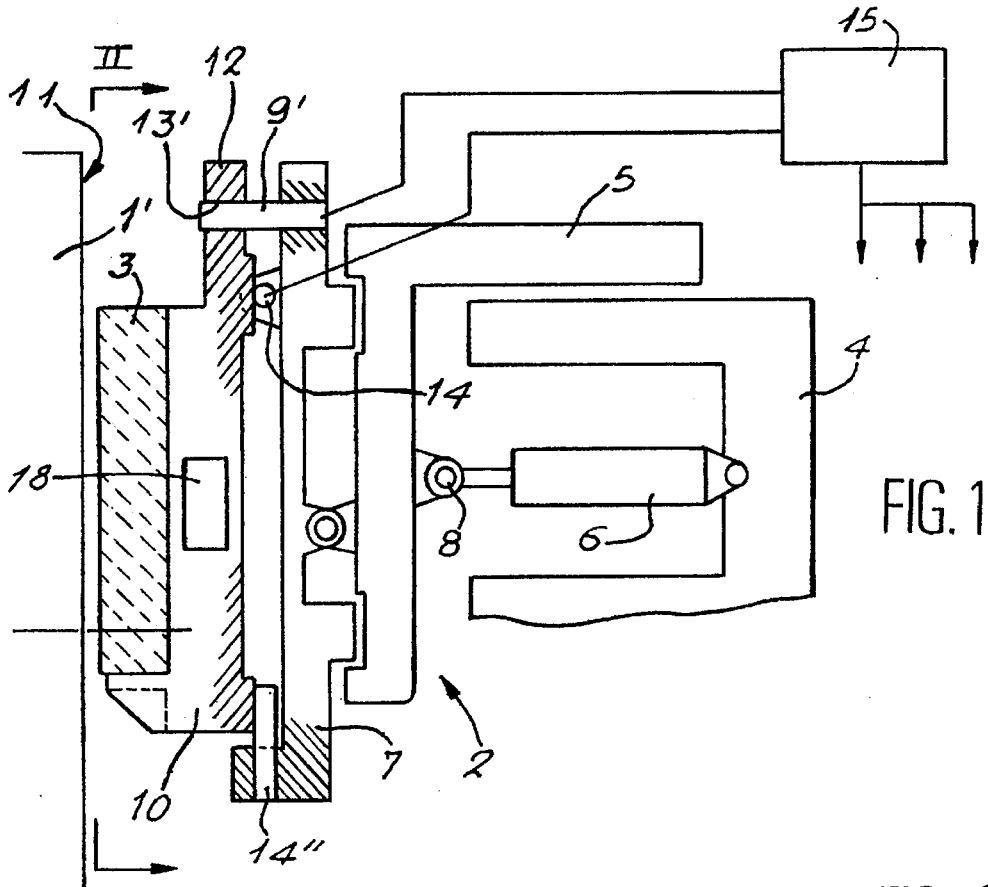

The present invention relates to continuous casting of thin metal products, in particular thin steel strips, according to the continuous casting technique between two counter-rotatory rolls, and more particularly to management of the contact and of the lubrication between the front ends of such rolls and the side dams which are applied against these front ends, in order to delimit the casting space defined between the rolls.

Known installations for continuous casting between rolls include two internally cooled rolls with horizontal and parallel axes, driven in rotation in opposite senses and spaced apart by a distance corresponding to the desired thickness of the cast product.

During casting, the molten metal is poured into the casting space defined between the rolls, solidifies in contact with these rolls and is extracted downwards, as they rotate, in the form of a thin strip. In order to contain the molten metal, the side dams are pressed flat against the front ends of the rolls. Such side dams are commonly made of refractory material, at least in their part which is brought into contact with the molten metal.

It is therefore necessary to ensure leaktightness between the rolls and the side dams. For this purpose, these side dams are pressed against the ends of the rolls and, in order to reduce the friction induced during rotation of the rolls, lubrication of the interface between roll and side dam is usually provided by supplying a consumable lubricant or by using a self-lubricating material at this interface.

However, actually producing this leaktightness and retaining it throughout the casting raises numerous difficulties, due in particular:

- to the geometrical deformations of the rolls and of the side dams, in particular at the start of casting, which are caused by expansions of the various elements of the installation,
- to the forces exerted on these elements, in particular the forces exerted on the side dams by the cast metal in the axial direction of the rolls, which forces tend to separate the said side dams from the rolls,
- to wear of the side dams or of the edges of the cooled walls of the rolls, which is not always uniform over the entire area of the contact zones,
- to the possible beginning of infiltration of cast metal between side dam and roll, which tends to separate one from the other.

In order to attempt to ensure this leaktightness as well as possible, and avoid infiltration of cast metal between the rolls and the side dams, a plurality of methods are already known, consisting respectively in

- adjusting the pressure force of the side dams against the edge of the rolls in order to keep it in a given value interval,
- adjusting the position of the side dams in order to ensure minimal play between these side dams and the rolls,
- measuring this play and adjusting the pressure force accordingly.

None of these methods has proved satisfactory, or at least sufficient, for ensuring leaktightness throughout the casting process, because it is possible only to measure resultant forces exerted on the side dam, or an overall position of this dam, without being capable of taking into account point forces or plays located on small zones of the interfaces.

It has also been proposed to solve this problem by causing controlled wear of the side dam, by friction of the rolls against the latter, throughout the casting. The aim is thus to regenerate the interface between the side dam and roll continuously, so as to make the contact conditions over the entire area of this interface as uniform as possible. Thus, document EP-A-0546206 describes a method according to which, before the start of casting, the side dams are pressed strongly against the rolls, in order to carry out a sort of grinding-in of these side dams by abrasion by the edges of the rolls, then this pressure is reduced and, during casting, the side dams are continued to be moved towards the rolls at a predetermined speed in order continuously to ensure the progress of intentional wear and thus to attempt to retain uniform contact over the entire area of the interfaces.

However, this method does not make it possible to take into account the random variations in the contact conditions which may occur during casting, and leads to significant wear of the side dams, even when the contact conditions are satisfactory and would not require such wear to caused.

The object of the present invention is therefore to solve the problems mentioned above and to improve management of the contact between the side dams and the rolls, while avoiding significant wear of the side dams. More particularly, the object of the invention is to improve knowledge of the true state of the contact between the side dams and the rolls, continuously during casting, in order to make it possible to act accordingly on the means for applying pressure and for positioning the side dams against the rolls.

With these objects in mind, the subject of the invention is, in particular, a method for continuous casting of thin metal products between two counter-rotating rolls, according to which molten metal is poured into a casting space defined by the cylindrical walls of the rolls and two side dams and the solidified thin product is extracted in an extraction direction, a thrust force is exerted on the side dams in a direction parallel to the axes of the rolls, in order to apply them against the front ends of the cylindrical walls, and the force is measured, characterized in that, in order to evaluate the contact state between the side dam and cylindrical wall continuously during casting, the drive forces exerted on each side dam in the extraction direction are measured, this measurement being carried out for each side dam at each roll, and a quantity, representative of the friction conditions at each of the side dam/cylindrical wall contact surfaces is deduced from the measured values of the pressure forces and of the drive forces, the value of the quantity is compared with a predetermined set-point value, and at least one casting parameter is adjusted as a function of the result of this comparison in order to return this quantity to the set-point value.

The method according to the invention therefore allows much better knowledge of the true side dam/roll contact state, since it adds to the already known measurements of the thrust force exerted on the said dam and of its position, a measurement of a quantity representative of the friction conditions, for example a coefficient of friction. This makes it possible to assess the variations in the friction of the surfaces in contact with respect to a reference, for example in the state before introduction of the cast metal into the casting space. Knowledge of the friction, in combination with that of the position of the side dam and of the thrust force exerted on the latter makes it possible, for example, to assess a variation in the effective contact area which may be due to uneven wear of the refractory material, to infiltration of cast metal between roll and side dam, or else to the latter being positioned not parallel to the front surface of a roll. It is also possible to assess a possible lubrication deficiency. It consequently becomes possible to react, manually or automatically, in order to correct these defects, while taking into account their causes, by acting on certain casting parameters such as the thrust force on the side dam, the position of the latter or else the clamping force of the rolls, their speed, etc.

A further subject of the invention is a device for continuous casting of thin metal products between rolls, including:

two rolls having parallel axes of rotation and cooled cylindrical walls, which rolls are arranged symmetrically with respect to a median extraction plane and are driven in rotation in opposite directions, two side dams arranged against the front ends of the cylindrical walls, thrust means for applying the side dams against the cylindrical walls with a thrust force, and means for measuring the thrust force, characterized in that it comprises means for measuring the friction force exerted on the side dams by the rolls during their rotation.

Preferably, the means for measuring the friction force include, for each side dam, two force sensors for measuring the friction forces exerted on the side dam by each of the rolls. It is thus possible further to improve knowledge of the side dam/roll contact state by separately assessing this state at each roll.

According to a particular arrangement, the force sensors are situated respectively on either side of the median plane, and the side dam is supported, in the extraction direction, only by two support means placed respectively towards the lateral ends of the dam, and the force sensors are situated in the support means.

This arrangement allows simple production of the device, it being possible, for example, for the support means to be dynamometric shafts fixed horizontally on the structure for holding and positional adjustment of the side dam, and on which the dam is simply attached.

Other characteristics and advantages will emerge from the description which will be given by way of example of a device according to the invention for continuous casting of thin steel strips between rolls, and of its implementation.

Figure 2:
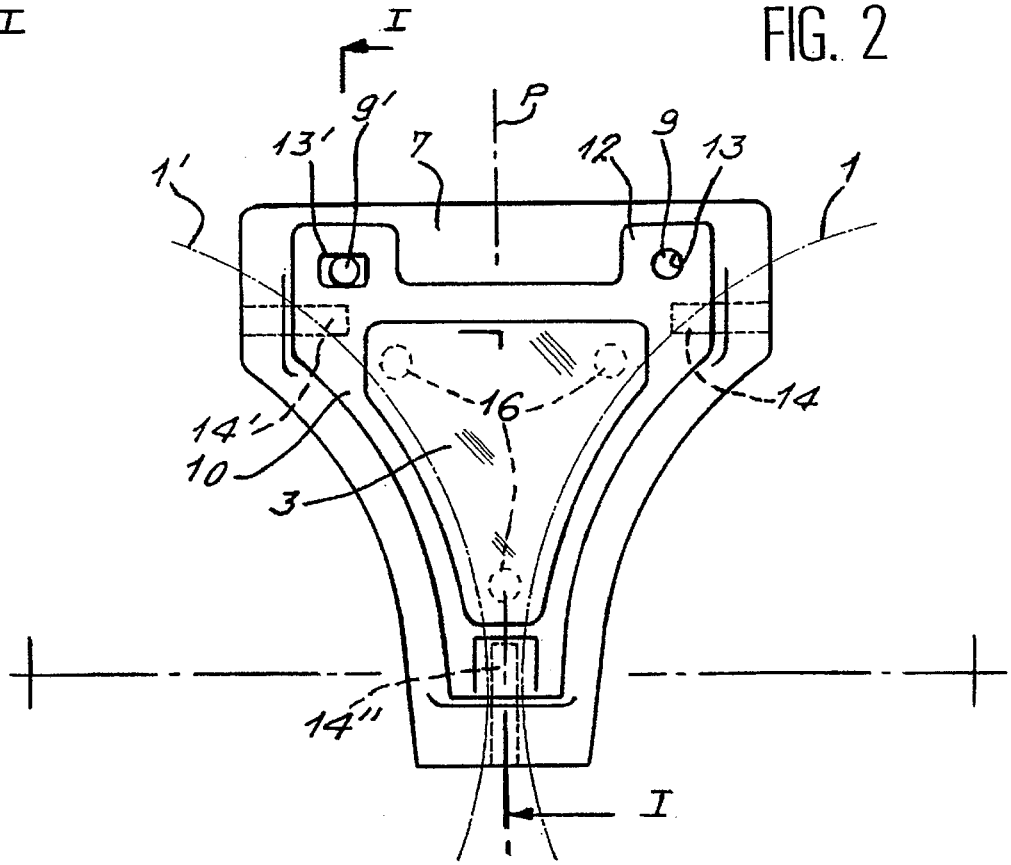

Reference will be made to the attached drawings, in which:

FIG. 1 is a partial sectional schematic view of a casting device taken along line I—I of FIG. 2, FIG. 2 is a front view of the side dam and of its support taken in the direction of line II—II of FIG. 1.

The drawing of FIG. 1 shows the end of one of the rolls 1, 1' of the installation and an assembly 2 for applying a side dam 3 against the edge 11 of the rolls. This assembly too is itself supported, in a manner which is known per se, on a framework 4 of the casting installation.

The assembly 2 contains a main carriage 5, guided in translation along the direction of the axes of the rolls, on the framework 4. Displacement of the main carriage is controlled by a jack 6 which makes it possible to adjust the position of the assembly 2, and therefore the side dam 3, with respect to the rolls 1, as well as to apply the side dam 3 against the edge of the rolls with an adjustable force.

The main carriage 5 carries a secondary carriage 7, guided horizontally on the main carriage 5, and therefore displaceable transversely to the direction of the axes of the rolls, by a jack schematically represented at 8, in order to adjust the transverse position of the side dam 3 with respect to the rolls.

The secondary carriage includes, at its upper part, two pins 9, 9' which extend horizontally, in the direction of the axes of the rolls, and are arranged symmetrically with respect to the longitudinal median plane P of the installation.

The side dam 3, made of refractory material, is held on a support plate 10 including lugs 12 at its upper part.

Each of the lugs includes a bore 13, 13' which engages on a pin 9, 9'.

One of the pins 9 is engaged practically without play in the corresponding bore 13, whereas the other bore 13' is made in the form of a horizontal oblong hole, so as to allow differential expansion between the support plate 10 and the secondary carriage 7, without constraining the pins 9, 9'.

Thus, the side dam 3 and its support 10 are simply suspended from the pins 9, 9' which include means for measuring the forces exerted on them, transversely to their axes. In practice, the pins 9, 9' constitute dynamometric shafts, making it possible to measure the forces exerted on them by the support 10, these forces resulting from the weight of the assembly comprising the support 10 and the side dam, from the downward driving force on the side dam 3 by the cast metal, and above all from the friction of this side dam against the edges of the rolls when the latter rotate.

Furthermore, the support 10 abuts via its rear face, in the direction of the axes of the rolls, against other dynamometric shafts 14, 14', 14" which are fixed on the secondary carriage 7 and which constitute means for measuring the horizontal force by which the side dam 3 is applied against the rolls. Two of these dynamometric shafts 14, 14' are arranged in the upper part of the assembly 2, on either side of the plane P and the third dynamometric shaft 14" is located towards the lower end of this assembly.

The support 10 therefore has three bearing zones, arranged in a triangle, and the aforementioned various dynamometric shafts thus make it possible to evaluate the distribution of the thrust forces pressing the dam 3 against the rolls, both in the vertical direction (shafts 9, 9') and in the horizontal direction (shafts 14, 14', 14"). It is thus possible to measure the value of the component of this thrust force relating to each roll separately and, by combining it with the value of the force measured by the dynamometric shaft 9, 9' located on the corresponding side, to evaluate a coefficient of friction specific to each of the side dams/roll interfaces.

Thus, calling $F_{V1}$ the vertical force measured by the dynamometric shaft 9, $F_{V2}$ the vertical force measured by the dynamometric shaft 9', $F_{H1}$ the horizontal force measured by the dynamometric shaft 14, $F_{H2}$ the horizontal force measured by the dynamometric shaft 14', $F_{H3}$ the horizontal force measured by the dynamometric shaft 14", $F_V$ the vertical friction force exerted on the side dam, and $F_H$ the overall force applying the side dam against the rolls, gives $F_V=F_{V1}+F_{V2}$ $F_H=F_{H1}+F_{H2}+F_{H3}$.

Since $F_{H3}$ is the application force of the side dam in the lower part of the dam, it can be decomposed into a force $k.F_{H3}$ of application onto the roll 1 and a force $(1-k).F_{H3}$ of application onto the other roll 1', k varying from 0 to 1 depending on whether the bottom of the side dam bears only on one roll, only on the other or on both at once, k representing the distribution of $F_{H3}$ between the two rolls.

Comparison of $F_{H1}$ and $kF_{H3}$ with $F_{H2}$ and $(1-k)F_{H3}$ gives an image of the states of application of the side dam against each of the rolls. The orders of magnitude of the friction coefficients of the side dam against each of the rolls are expressed $$\text{by } \frac{F_{V1}}{F_{H1}+k\cdot F_{H3}} \text{ for roll 1}$$

$$\text{by } \frac{F_{V2}}{F_{H2}+(1-k)F_{H3}} \text{ for roll 1'}$$

The dynamometric shafts 9, 9', 14, 14', 14" are connected to calculation and adjustment means 15 which can either display data representative of these coefficients of friction, in order to indicate possible anomalies to the operator and allow him to remedy them by acting on the various parameters of the casting, or to act directly on these parameters, for example on the application force of the side dam 3 against the rolls by acting on the supply pressure of the jack 6 or on the position of the side dam with respect to the edge of the rolls, by causing suitable displacement of the jack.

The device also includes position sensors 16, schematically represented in FIG. 2, for example placed at the support 10, and preferably arranged in a triangle like the dynamometric shafts 14, 14', 14". The sensors make it possible to detect the displacements of the support 10 of the dam 3, either with respect to a fixed reference or with respect to the edges of the rolls, or both, and to do this independently for the various zones of the side dam.

These sensors thus make it possible to detect and evaluate either an overall displacement of the support in the direction of the axes or an inclination of the side dam with respect to the normal reference plane perpendicular to the axes of the rolls. These displacements may be in the direction away from the rolls, which occurs, for example, if cast metal infiltrates between the side dam 3 and the edge of a roll and tends to separate them. These displacements may also be in the direction towards the rolls, for example following wear of the refractory material of the side dam 3, leading to an instantaneous decrease in the bearing force of this dam on the roll located on the side on which the wear has occurred and to a response reaction of the jack 6 which displaces the assembly 2 until the bearing force returns to a sufficient level.

In view of the above example, the full advantage will already have been understood of being capable of simultaneously measuring the position of the support of the side dam 3 with respect to a fixed reference, or the position of this dam directly with respect to the rolls, and the force corresponding to the pressure exerted by the side dam 3 on one or other of the rolls.

By adding thereto a measurement of the vertical forces exerted during casting on the side dam 3, and the available knowledge of the contact state between side dam and roll is further improved for each roll.

For example, at constant bearing force of the side dam on the edge of a roll, measured by one of the dynamometric shafts 14, 14', 14", an increasingly vertical force measured by a dynamometric shaft 9, 9' may indicate a lubrication defect.

By measuring the vertical forces and the bearing force of the side dam 3, it is possible to deduce therefrom a coefficient of friction at the interface between the side dam and one of the rolls, and therefore the horizontal component of the friction forces which is added to the separating force of the rolls generated by the cast metal, and by measuring the total clamping force of the rolls, that is to say the force exerted in order to keep them at the correct distance from each other, it is possible to deduce therefrom by subtraction the part of this force specifically corresponding to the force generated by the cast metal, which is an indicator of the solidification state of the cast product.

The combination of these various measurements therefore makes it possible to obtain much additional information on the side dam/roll contact state and to correct the parameters of the casting accordingly, in order to keep the casting installation in an optimal state, allowing observed starts of degradation to be corrected rapidly and before these degradations become irreversible and can cause shutdown of the casting.

In particular, it is possible to adjust the pressure force of the side dam on the rolls, or the position of this side dam, either manually or automatically, as a function of detected variations in coefficients of friction.

In order further to improve knowledge of the side dam/roll contact state, it is further possible to place a vibration sensor 18 on the side dam or its support, an increase in the vibrations detected also being indicative of degradation in the state of this contact.

It should also be noted that, even if the side dam and its support are not articulated with respect to the intermediate carriage or the assembly 2, the inevitable functional plays in this assembly lead to the possibility of the dam and its support undergoing limited rotations in their overall plane, which is theoretically perpendicular to the axes of the rolls. This moreover makes it possible to prevent a significant play from being created, for example between the side dam and one of the rolls, as a result of more pronounced wear on the side of this roll than of the other. For such a case, under the force of the thrust exerted by the jack 6, the side dam 3 will be applied against the rolls while being slightly oblique. An increased thrust force will then lead to an increase in the preferential friction on the side where the wear was less, and to dominant wear on this side, tending to return the side dam into a normal orientation of its overall plane, precisely perpendicular to the axes of the rolls. The same effect could be produced in the event that wear might be more pronounced towards the bottom than towards the top of the side dam.

The invention is not limited to the particular arrangements of the devices or to the embodiments described above by way of example.

In particular, the number and the arrangement of the various force and/or displacement sensors may be modified without departing from the field of the invention.

We claim:

1. A method for continuously casting thin metal products between two counter-rotating rolls with each roll having an axis of rotation and a generally cylindrical outer wall, and with each wall having outwardly facing axial front ends, according to which molten metal is poured into a casting space defined by said cylindrical walls of said rolls and a pair of side dams each of which engages both of said rolls, and wherein a solidified thin metal product is extracted in an extraction direction that is generally perpendicular to said axes of said rolls, a thrust force is exerted on said side dams in a direction parallel to said axes of said rolls in order to urge them against said front ends of said cylindrical walls, drive forces are exerted by each roll on both of said side dams in said extraction direction, and said thrust force is measured, comprising the steps of:

(a) evaluating the state of contact between each said side dam and each said cylindrical wall; said evaluating step including (i) measuring said drive forces exerted on each side dam, this measurement being carried out for each side dam at each roll;

(ii) deducing from the measured values of the thrust forces and the drive forces, quantity representative of friction conditions at each contact surface between each said side dam and each of said cylindrical walls; and (iii) comparing the value of said quantity with a predetermined setpoint value; and (b) adjusting at least one casting parameter as a function of the result of this comparison in order to return this quantity to the set-point value.

2. Method according to claim 1 wherein said thrust force urging said side dam against said rolls is adjusted as a function of the values of said deduced quantity representative of the friction conditions.

3. Method according to claim 1 wherein the position of said side dam relative to said rolls is adjusted as a function of the value of the deduced quantity representative of the friction conditions.

4. Method according to claim 1 wherein said deduced quantity representative of the friction conditions is the coefficient of friction.

5. Device for continuous casting of thin metal products between rolls, including:

(a) two rolls having parallel axes of rotation and cooled cylindrical walls having outer axial ends, with said rolls i) arranged symmetrically with respect to a median extraction plane (P) along which a solidified thin product is extracted from said rolls and ii) driven in rotation in opposite directions, (b) two side dams each of which is urged against one of the ends of both of said cylindrical walls, (c) thrust means for urging said side dams against said cylindrical walls with a thrust force, (d) means for measuring the thrust force exerted on each side dam, (e) means for measuring drive forces exerted on each side dam in a direction generally perpendicular to the axes of rotation of said rolls, and (f) means for deducing, from the measured values of the thrust forces and the drive forces, a quantity representative of friction conditions at each contact surface between each said side dam and each of said cylindrical walls.

6. Device according to claim 5, wherein said means for deducing the friction conditions include, for each side dam, two force sensors for measuring the friction forces exerted on said side dam by each of said rolls.

7. Device according to claim 6, wherein said force sensors are situated respectively on either side of said median plane (P).

8. Device according to claim 7, wherein each said side dam is supported, in the in which direction solidified thin product is extracted from said rolls, only by two supports placed respectively towards the lateral ends of said side dam, and wherein said force sensors are situated in said support means.

9. Device according to claim 5, further comprising position sensors for measuring the position of said side dams with respect to said ends said cylindrical walls.

10. Device according to claim 5, further comprising a vibration sensor on each side dam.

11. Device according to claim 5, where said means for measuring the thrust force include, for each side dam, force sensors arranged on either side of said median plane (P) in order to measure the thrust force at each of said rolls.

12. Device according to claim 9, wherein said means for measuring drive forces exerted on each said side dam measures drive forces exerted on each said side dam for each said roll.

* * * * *